United States Patent [19]

Jentzsch et al.

[11] Patent Number: 4,932,318

[45] Date of Patent: Jun. 12, 1990

[54] MULTI-COLOR PRINTING MACHINE

[75] Inventors: Arndt Jentzsch; Klaus Schanze, both of Coswig, German Democratic Rep.

[73] Assignee: Veb Kombinat Polygraph "Werner Lamberz" Leipzig, Lepzig, German Democratic Rep.

[21] Appl. No.: 305,364

[22] Filed: Feb. 1, 1989

[30] Foreign Application Priority Data

Feb. 4, 1988 [DD] German Democratic Rep. ... 312642

[51] Int. Cl.[5] ..... B41F 5/16; B41F 5/22

[52] U.S. Cl. ..... 101/136; 101/175; 101/177

[58] Field of Search ..... 101/175, 176, 183, 181, 101/177, 137, 142, 143, 144, 217, 136, 138

[56] References Cited

U.S. PATENT DOCUMENTS 4,479,431 10/1984 Germann ..... 101/175

FOREIGN PATENT DOCUMENTS 489839 8/1938 United Kingdom ..... 101/211

*Primary Examiner*—J. Reed Fisher

*Attorney, Agent, or Firm*—Michael J. Striker

[57] ABSTRACT

A multi-color printing machine comprises a print carrier supplying system including a print carrier supply unit, a print carrier transporting unit and a print carrier discharge unit, and a printing image supplying including at least two printing mechanisms each having a plate cylinder and an offset cyinder, the offset cylinders being arranged in contact with one another and of the offset cylinder being arranged in contact with the print carrier transporting unit, the print carrier transporting unit being formed as a central printing cylinder which cooperates with the print carrier withdrawal unit and with the print carrier supply unit and is provided with at least one gripper element, the printing image supplying system also including an endless band-shaped printing image collecting element associated with at least first and last of the offset cylinders of first and last of the printing mechanisms through at least one connecting cylinder.

7 Claims, 3 Drawing Sheets

MULTI-COLOR PRINTING MACHINE

BACKGROUND OF THE INVENTION

The present invention relates to a multi-color printing machine, especially for sheet offset printing.

Multi-color printing machines of the above mentioned general type are widely known in the art. One such printing machine is disclosed, for example in the German document DE No. 3,203,948. In this printing machine the rubber cylinders of the individual printing mechanisms are arranged in series and in contact for ink transmission and one cylinder which simultaneously forms the feeding drum and the deviating system of the outfeed chain circuit is pressed against a rubber cylinder. The disadvantage of this construction is that in these machines because of the higher than-average number of gap points an ink layer thickness regulation in correspondence with the differently long paths of the ink to the ink transmission on the print carrier is quite problematic. This machine concept is not suitable for modern machines with a great number of printing mechanisms, especially a 10 ink machines because of the above mentioned disadvantages.

SUMMARY OF THE INVENTION

Accordingly, it is an object of the present invention to provide a multi-color printing machine which avoids the disadvantages of the prior art.

More particularly, it is an object of the present invention to provide a multi-color printing machine in accordance with an image transporting principle in which ink losses due to the differently long paths of the ink to the ink transfer are compensated and which can have a plurality of printing mechanisms.

In keeping with these objects and with others which will become apparent hereinafter, one feature of the present invention resides, in a multi-color printing machine with a print carrier supply, a print carrier transport and a print carrier withdrawal at least two printing mechanisms each having a plate cylinder and an offset cylinder, wherein the offset cylinders are arranged in contact with one another and one of the offset cylinders is arranged in a contact with the print carrier transport, in which printing machine the print carrier transport is formed as a central printing cylinder cooperating with the print carrier supply and print carrier withdrawal and provided with at least one gripping unit and at least one first and last offset cylinder of the first and last printing mechanism are associated with at least one endless band-shaped printing image collecting element.

It is to be understood that each printing mechanism can also be provided with inking and moisturizing elements.

The endless band-shaped printing image collecting element is guided over deviating rollers.

Still another feature of the present invention is that the offset cylinders are arranged in contact through an intermediate offset cylinder.

A further feature of the present invention is that the printing image collecting element is formed as an endless offset printing blanket. On the other hand, an offset printing blanket piece can be connected with the printing image collecting element. Finally, the printing image collecting element can be provided with a gripper system for an offset printing blanket portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

A multi-color printing machine is formed as a sheet printing machine. It is composed of a sheet supplying system and a printing image supplying system.

Figure 1:
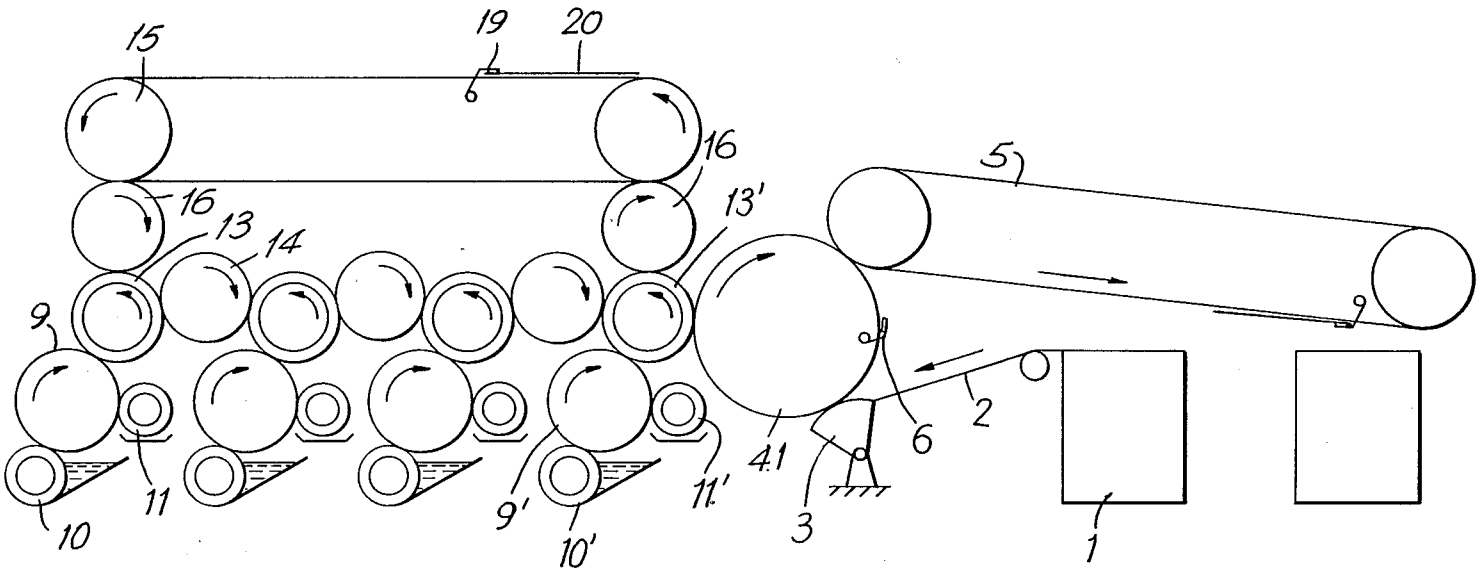
FIG. 1 is a view showing a multi-color printing machine in accordance with a first embodiment of the invention.

The sheet conveying system shown in FIG. 1 comprises a print carrier supply with an infeed 1, a supply table 2, a sheet transfer 3 formed for example as a pregripper. It further includes a printing carrier transporting system which is formed as a central sheet supply cylinder 4.1, and a printing carrier withdrawal formed as a sheet outfeed 5. The central sheet supply cylinder 4.1 has two gripper units 6; it is to be understood that the number of the gripper units can be increased or reduced.

The pressure image supplying system shown in FIG. 1 includes at least two printing mechanisms each having a plate cylinder 9 and 9', an inking mechanism 10 and 10', a dampening mechanism 11 and 11', and an offset cylinder 13 and 13'. The offset cylinder 13 and 13' are arranged in contact via intermediate offset cylinders 14. The offset cylinder 13' of the last printing mechanism is arranged in contact with the central sheet supply cylinder 4.1.

Figure 2:
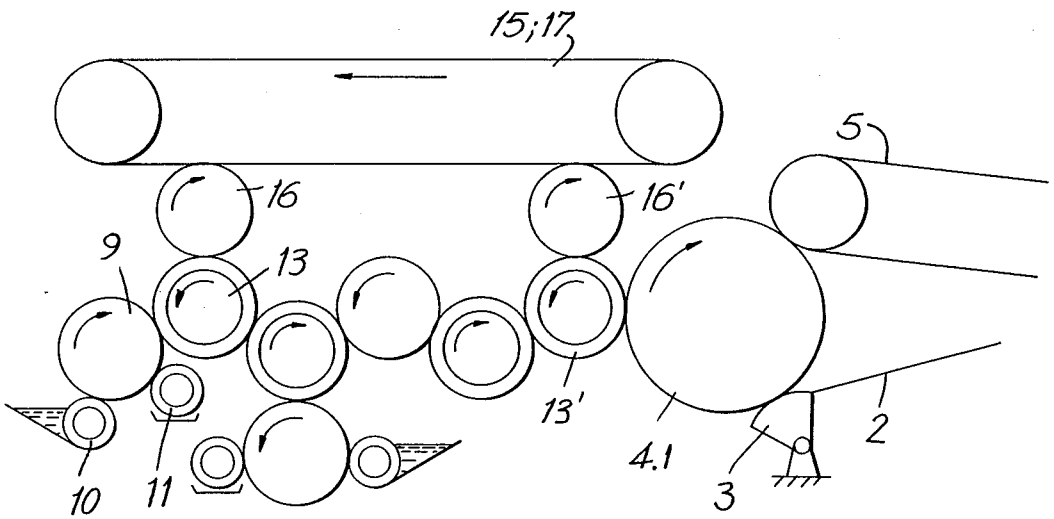
FIG. 2 is a view showing a multi-color printing machine in accordance with a second embodiment of the invention.

The printing image supply in accordance with FIG. 2 includes at least two printing mechanisms each having a plate cylinder 9 and 9', an inking mechanism 10 and 10', a dampening mechanism 11 and 11' and an offset cylinder 13 and 13'. The offset cylinders 13 and 13' are arranged in contact directly or via the offset cylinder of further printing mechanism. The offset cylinder 13' of the last printing mechanism is arranged in contact with the central printing cylinder 4.1.

Figure 3:
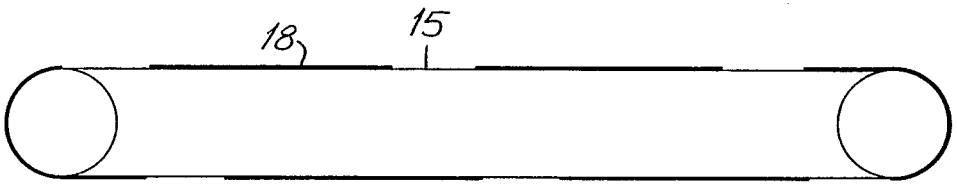
FIG. 3 is a view showing a printing image collecting element.

The printing image supplying system in accordance with FIGS. 1 and 2 further contains an endless band-shaped printing image collecting element 15 which is guided over deviating rollers. The printing image collecting element 15 is arranged in contact via a connecting cylinder 16 with the first and last offset cylinder 13 of the first and last printing mechanisms. The printing image collecting element 15 can be formed as an endless offset printing blanket 17. On the other hand, at least one offset printing blanket pieces can be connected with the printing image collecting element 15. FIG. 3 shows several offset printing blanket piece 18 connected with the printing image collecting element to provide an intermediate space for the gripper system 6. Printing image collecting element 15 can also be formed as at least one offset printing blanket portion 20 and is transported on a front edge or a front edge and rear edge and/or side edges of the gripper unit 19 as shown in FIG. 1.

The operation of the inventive printing machine is described hereinbelow. A sheet withdrawn from the infeed 1 is conveyed through the supply table 2 and the sheet transfer 3 to the central printing cylinder 4.1.

By means of the plate cylinder 9 and 9' and the offset cylinder 13 and 13' of each printing mechanism in connection with the dampening and inking mechanism 11, 10 and 11', 10'a printing image is produced and transported. Through the intermediate offset cylinder 14 or the direct contact, the printing image is transferred to the offset cylinder of the subsequent printing mechanism. Instead of the last offset cylinder 13' of the last printing mechanism, the printing image is transferred onto the printing sheet supplied by the central printing cylinder 4.1.

Simultaneously, for eliminating the ink losses, the printing image is transferred from the offset cylinder 13 of the first printing mechanism through the connecting cylinder 16, the printing image collecting element 15, the connecting cylinder 16' of the last printing mechanism onto the offset cylinder 13' of the last printing mechanism.

In a printing machine with a plurality of printing mechanisms all or only a selected number of the offset cylinders can be arranged in contact through the connecting cylinder 16 with the printing image collecting element 15. Furthermore, it is also possible that the pressure image transfer through the offset cylinder or the intermediate offset cylinder is interrupted at any points.

It will be understood that each of the elements described above, or two or more together, may also find a useful application in other types of constructions differing from the types described above.

While the invention has been illustrated and described as embodied in a multi-color printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A multi-color printing machine, comprising a print carrier supplying system including print carrier supply unit, print carrier transporting unit and print carrier withdrawal unit; and a printing image supplying system including at least two printing mechanisms each having a plate cylinder and a offset cylinder, said offset cylinders being arranged in contact with one another and one of said offset cylinders being arranged in contact with said print carrier transporting unit, said print carrier transporting unit being formed as a central printing cylinder which cooperates with said print carrier withdrawal unit and with said print carrier supply unit, said central printing cylinder being provided with at least one gripper element, said printing image supplying system also including an endless band-shaped printing image collecting element associated with at least first and last of said offset cylinders of first and last of said printing mechanisms through at least one connecting cylinder.

2. A multi-color printing machine as defined in claim 1; and further comprising rotatable deviating rollers which guide said endless band-shaped printing image collecting element.

3. A multi-color printing machine as defined in claim 1, wherein each of said printing mechanisms is provided with an inking mechanism and a moisturing mechanism.

4. A multi-color printing machine as defined in claim 1; and further comprising an intermediate offset cylinder through which said offset cylinders are arranged in contact.

5. A multi-color printing machine as defined in claim 1, wherein said printing image collecting element is formed as an endless offset printing blanket.

6. A multi-color printing machine as defined in claim 1; and further comprising at least one printing blanket piece, said printing image collecting element being connected with said at least one of said printing blanket piece.

7. A multi-color printing machine as defined in claim 1, wherein said image collecting element is provided with at least one gripper system and an offset printing blanket portion.

* * * * *